United States Patent [19]

Lonczak

[11] Patent Number: 4,798,317

[45] Date of Patent: Jan. 17, 1989

[54] MANNEQUIN FORMED OF SHEET MATERIAL

[76] Inventor: John Lonczak, 430 W. 24th St., New York, N.Y. 10011

[21] Appl. No.: 103,388

[22] Filed: Oct. 1, 1987

[51] Int. Cl.[4] ..... A41H 5/00; A63H 3/08

[52] U.S. Cl. ..... 223/66; 446/382; 446/388

[58] Field of Search ..... 223/66, 71, 84, 120; 446/382, 387, 388, 488, 362, 363

[56] References Cited

U.S. PATENT DOCUMENTS

| | | | |
|---|---|---|---|
| 1,208,233 | 12/1916 | Taylor | 223/71 X |
| 2,170,953 | 8/1939 | Spots | 446/388 |
| 2,238,455 | 4/1941 | Steinhilber | 446/388 |
| 2,704,910 | 3/1955 | Paige | 446/388 |
| 3,212,214 | 10/1965 | Patterson | 446/388 |
| 4,630,762 | 12/1986 | Stringer | 223/66 |

FOREIGN PATENT DOCUMENTS

| | | | |
|---|---|---|---|
| 505217 | 5/1920 | France | 446/382 |
| 405771 | 2/1934 | United Kingdom | 223/84 |
| 2030462 | 4/1980 | United Kingdom | 446/387 |
| 2155344 | 9/1985 | United Kingdom | 446/387 |

*Primary Examiner*—Robert R. Mackey
*Attorney, Agent, or Firm*—Michael Ebert

[57] ABSTRACT

A mannequin providing a small scale model of a living or fanciful figure, the mannequin being created from a blank of non-woven, synthetic plastic, flexible sheet material having paper-like qualities. The blank is die-cut to define a predetermined pattern of interconnected sections. Each section is contoured to provide the form of a particular member of the figure and includes locking tabs projecting from one edge thereof and complementary slots adjacent the opposing edge to receive the tabs. Each section is convertible into a locked tubular element by rolling the section and inserting the tabs thereof into the slots. The sizes and shapes of the resultant tubular elements simulate the members of the figure. By means of different pattern designs, blanks may be provided each capable of creating a unique three-dimensional figure formed by interconnected tubular elements whose sizes and shapes are appropriate to the figure implicit in the picture.

6 Claims, 3 Drawing Sheets

MANNEQUIN FORMED OF SHEET MATERIAL

BACKGROUND OF INVENTION

1. Field of Invention

This invention relates generally to mannequins, and in particular to a mannequin whose figure is formed from a die-cut blank of paper-like material that is convertible into interconnected tubular elements each defining a component part of the figure.

2. Status of Prior Art

The term "mannequin" or "manikin" literally means little man. Mannequins serve to exhibit the parts of a body and their relative positions. They are used as lay figures by artists and designers, and can be manipulated to illustrate body movements. A mannequin which is a model of a human figure is traditionally formed of shaped wood pieces which are either detachable from each other or interhinged.

Various attempts have heretofore been made to fabricate mannequins of materials other than the traditional solid wood. Thus the patent to U.S. Pat. No. 1,833,503, shows a mannequin formed by interconnected pieces of stamped metal tubing. The Ziegler U.S. Pat. No. 3,361,310 discloses a display mannequin formed of tubular elements of sheet material. These elements are disconnected; hence mechanical expedients are provided to join the elements together to create the model form.

One practical disadvantage of mannequins of the type heretofore known is that they are difficult to fabricate and therefore relatively expensive. Also, because they are threedimensional forms, they require a relatively large container for shipment and storage.

The present invention makes use of a die-cut blank of synthetic plastic sheet material having paper-like qualitiss which is convertible into three-dimensional tubular elements. The following prior art U.S. patents, though not relating to mannequins, are nevertheless of background interest, for they disclose sheets that are convertible into three-dimensional forms.

Cohen, U.S. Pat. No. 2,012,498
Henderson, U.S. Pat. No. 3,330,452
Cella, U.S. Pat. No. 3,140,023
Leverson et al., U.S. Pat. No. 3,258,180

SUMMARY OF INVENTION

In view of the foregoing, the main object of this invention is to provide a mannequin which can be made to assume any desired figurative form, simply by designing and die-cutting a pattern therefor on a flat blank, which mannequin can be massproduced at low cost.

More particularly, an object of this invention is to provide a mannequin that is transformable from a flat die-cut blank formed of low-cost, non-woven synthetic plastic sheet material having paper-like qualities into a three-dimensional figure whose form depends on the die-cut pattern.

Also an object of the invention is to provide mannqquins which may assume animal-like as well as humanoid forms.

Yet another object of the invention is to provide mannequins that can be packaged, stored and shipped in a flat state.

A significant advantage of a mannequin in accordance with the invention is that its utility is not limited to artists, designers and others who have need for mannequins, for the paperlike mannequin is also useful as a craft toy for children. The mannequin has both play and educational value, for some degree of skill and care is involved in rolling the sections of the blank into locked tubular elements, each representing a body member. Also, by securing strings to the tubular elements which represent the movable members of a living figure, the mannequin can be used as a marionette.

Briefly stated, these objects are attained in a mannequin providing a small scale model of a living or fanciful figure, the mannequin being created from a blank of non-woven, synthetic plastic, flexible sheet material having paper-like qualities. The blank is die-cut to define a predetermined pattern of interconnected sections. Each section is contoured to provide the form of a particular member of the figure and includes locking tabs projecting from one edge thereof and complementary slots adjacent the opposing edge to receive the tabs. Each section is convertible into a locked tubular element by rolling the section and inserting the tabs thereof into the slots. The sizes and shapes of the resultant tubular elements simulate the members of the figure. By means of different pattern designs, blanks may be provided each capable of creating a unique three-dimensional figure formed by interconnected tubular elements whose sizes and shapes are appropriate to the figure implicit in the picture.

BRIEF DESCRIPTION OF DRAWINGS

For a better understanding of the invention as well as other objects and further features thereof, reference is made to the following detailed description to be read in conjunction with the accompanying drawings, in which.

DESCRIPTION OF INVENTION

First Embodiment

Figure 1:
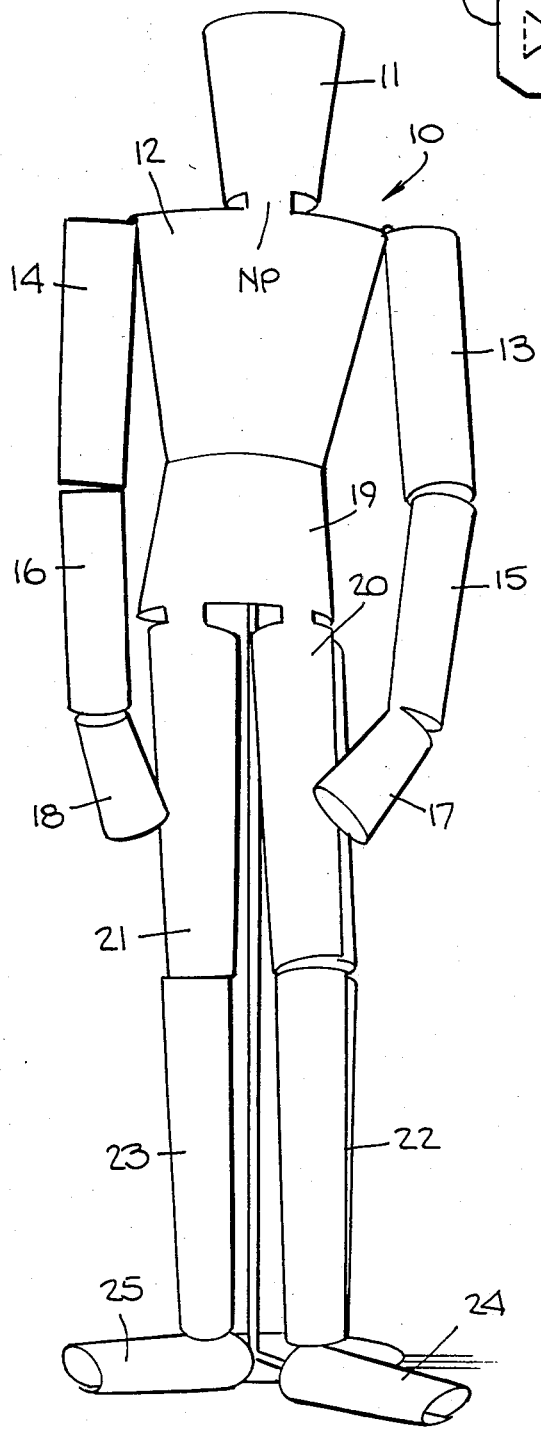
FIG. 1 illustrates, in perspective, one preferred embodiment of a mannequin in accordance with the invention.

Referring now to FIG. 1, there is shown a mannequin in accordance with the invention formed of non-woven,synthetic plastic material having paper-like qualities, such as TYVEK or MASTERFLEX. Material of this type is durable, washable and of high strength so that it cannot be easily torn. Also, the material can be multi-color printed making it possible to provide decorative effects.

Paper-like materials made from synthetic fibers are manufactured by papermaking techniques in which a web of fibers is laid down on a paper machine using water as a carrier. Synthetic fibers currently used in paper making include nylon, Teflon, Dacron and cellulose acetate. Several methods for effecting bonding of the fibers are now in use, including resin bonding, thermoplastic bonding and solvent bonding. The invention is not limited to any particular type of synthetic fiber sheet material, although use is preferably made of a material which is relatively stiff and therefore, when rolled into a tubular form, retains this form.

Mannequin 10 is composed mainly of interconnected tubular elements whose sizes and shapes simulate the members of the human body. The mannequin includes a head element 11 supported by a neck piece NP joined to the upper end of a chest element 12. Joined to chest element 12 are arm elements 13 and 14 to which are joined forearm elements 15 and 16. Hand elements 17 and 18 are joined to the forearm elements. Connected to chest element 12 is a torso element 19 on which are hinged limbs 20 and 21. Leg elements 22 and 23 are hinged to limbs 20 and 21, and joined to the leg elements are feet elements 24 and 25, respectively.

Figure 2:
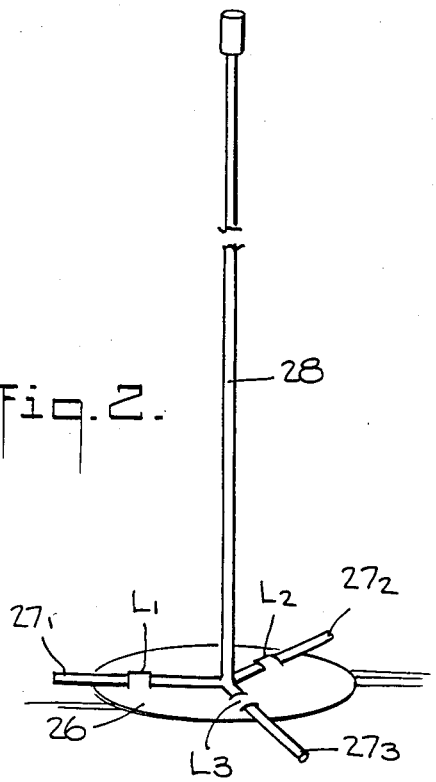
FIG. 2 separately illustrates a collapsible stand for supporting the mannequin.

Mannequin 10 is maintained at an upright position by a stand which in FIG. 2 is shown in its collapsed state. The stand is constituted by a disc-shaped cardboard ase 26 having three raised hoops $L_1$, $L_2$ and $L_3$ thereon spaced 120° apart. Inserted in these hoops are the metal rods $27_1$, $27_2$ and $27_3$ of a spider to whose hub is joined a standard 28.

Figure 3:
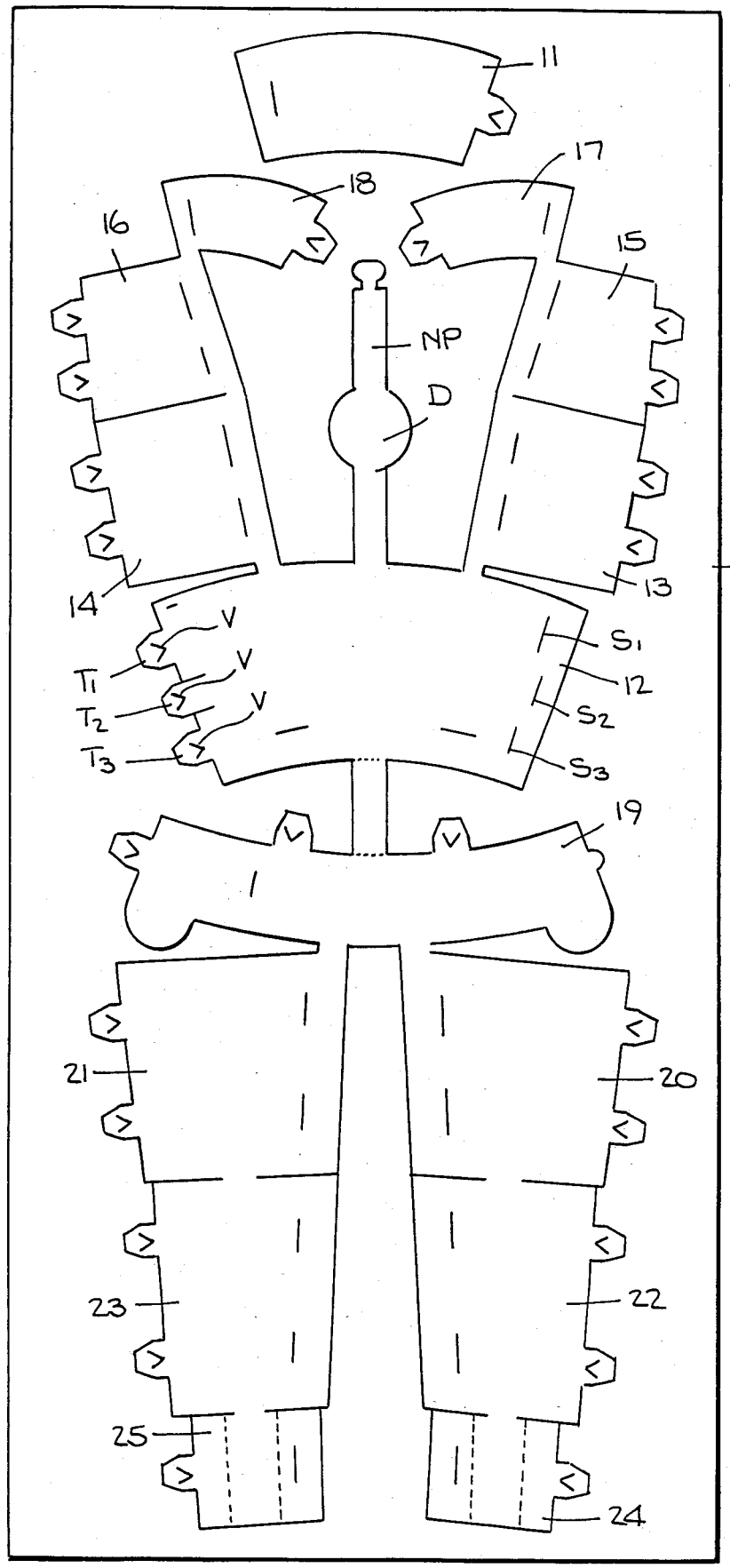
FIG. 3 shows the flat blank from which this mannequin is created.

FIG. 3 shows the flat blank 29 from which the mannequin is made, the blank being of synthetic plastic sheet material having paper-like qualities, as previously described. Blank 29 is die-cut to define the sections which when rolled and locked form the tubular elements of the body. All of the sections are joined together save for the section which forms head element 11 which rests on neck piece NP. This piece is bent into a U-shaped form and includes at its midpoint a disc D which fits snugly within the tubular head piece. Because of the nature of the material, even though the junctions between adjacent sections are relatively narrow, they are nevertheless strong and nontearable, which would not be true had the blank been made of ordinary paper.

Each section, such as section 12, is provided at one edge with locking tabs, three such tabs $T_1$, $T_2$ and $T_3$ being provided in this section. Each tab includes a triangular cut out forming a bendable lug V. Section 12 is provided adjacent its opposing edge with complementary slots $S_1$, $S_2$ and and $S_3$ which are adapted to receive the tabs.

Hence to convert flat section 12 into a tubular element, the section is rolled to cause the tabs projecting from one edge of the section to overlie the other edge thereof, the tabs then being inserted into the complementary slots. Before the tabs are inserted, the cut-out lugs V are bent out so that their points are displaced from the underside of the tabs. When, therefore, each tab is manually inserted in its complementary slot and then released, its lug V, which is then inclined relative to the surface of the slot, acts to prevent withdrawal of the tab therefrom.

Figure 4:
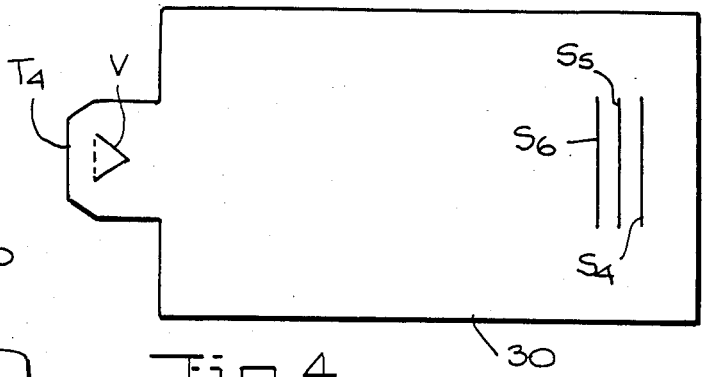
FIG. 4 illustrates a single blank section.
Figure 5:
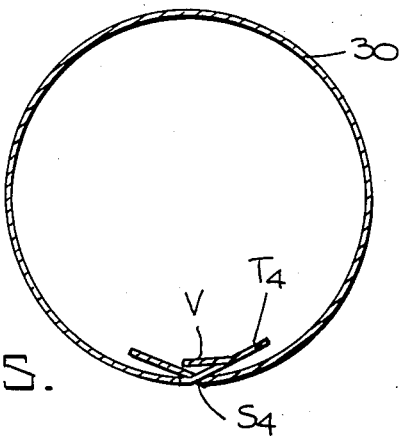
FIG. 5 shows how this single section of the blank is rolled and locked into a tubular element.

To demonstrate this locking action, FIG. 4 shows a single flat blank section 30 having a locking tab $T_4$ projecting from one edge thereof and a complementary slot $S_4$ adjacent the opposite edge. When, as shown in FIG. 5, this section is rolled into a tubular element and tab $T_4$ is inserted in slot $S_4$, then when the section is released, because of it inherent flexibility, it seeks to return to its flat state, in the course of which tab $T_4$ seeks to withdraw from the slot. However, the bent out lug V is then caught by the edge of slot $S_4$ to prevent withdrawal of the tab, thereby locking the tubular element. If one thereafter wishes to unroll this section, the tab is pushed into the slot to permit bending in lug V so as to free the tab and allow its withdrawal from the slot.

In order to convert the mannequin into a marionette, strings must be attached to the tubular elements which represent the movable members of the body to be manipulated. To facilitate the attachment of strings, small holes may be punched into the appropriate sections of the blank, the holes being so placed that when the section assumes a tubular form, a pair of holes are then disposed at diametrically-opposed positions so that one can pass a string through the opposed holes and then knot the string at its free end so that it cannot be pulled out of the holes.

Second Embodiment

Figure 6:
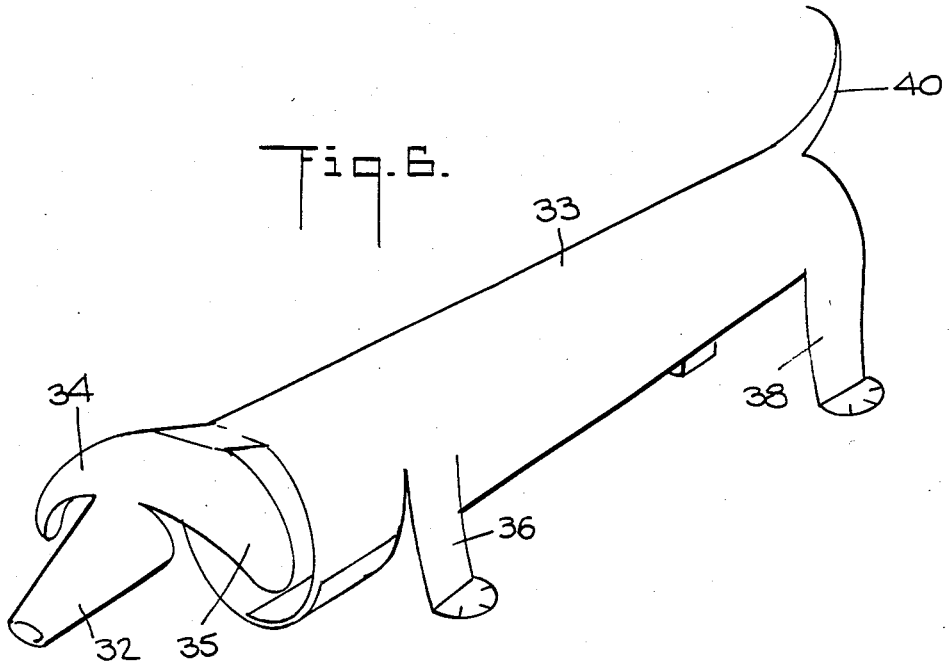
FIG. 6 shows an erected mannequin in accordance with the invention which is in a dog-like configuration.
Figure 7:
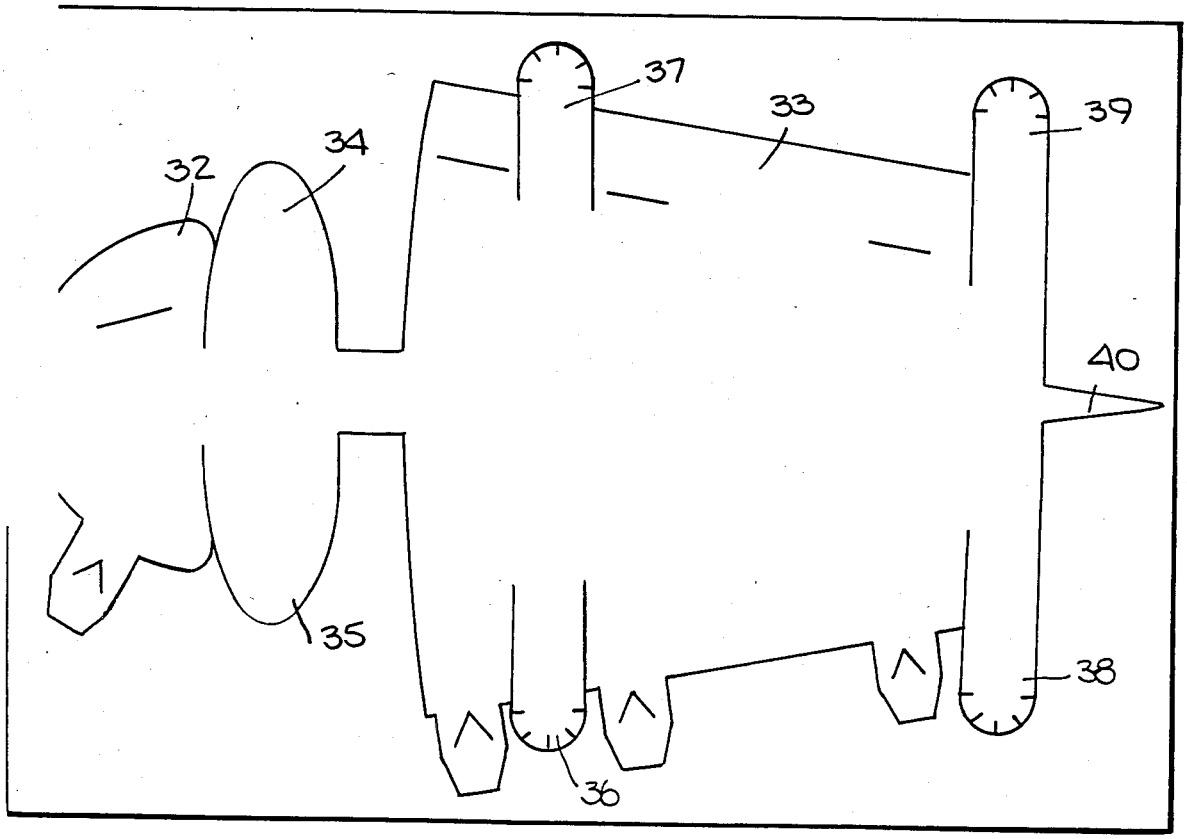
FIG. 7 shows the blank from which this dog-like mannequin is created.

The same technique used to create a mannequin in humanoid form as in FIG. 1 can be used to provide a mannequin in an animal-like form, such as the dog model shown in FIG. 6. The die-cut pattern for this dog is illustrated in FIG. 7.

In this instance, only two locked tubular elements 32 and 33 are required; one to represent the tapered tubular head of the dog and the other, the elongated body of the dog. The head-like element 32 is provided with a pair of shaped extensions or appendages 34 and 35 representing ears, while the body-like element 33 is provided with side extensions 36, 37, 38, 39 contoured to represent feet, and a rear extension 40 representing a tail.

It will be appreciated that a technique in accordance with the invention lends itself to patterning to create any natural or fanciful figure, so that one can form not only animal and humanoid models, but also monsters and science fiction creatures. By appropriate color printing of the blanks, these creatures can be made highly decorative. Thus a child provided with a set of die-cut blanks can transform the blanks into a zoo of different animals or a family of fantastic science fiction creatures.

And for play purposes, the blanks may be formed of plain white material and the sections thereof painted by the player in various colors, so that the resultant three-dimensional figure reflects the taste and imagination of the player.

While there have been shown and described preferred embodiments of mannequins formed of sheet material in accordance with the invention, it will be appreciated that many changes and modifications may be made therein without, however, departing from the essential spirit thereof.

Thus a mannequin in accordance with the invention need not be a reduced scale model of a figure, but may be a full scale or a magnified scale model thereof. In magnified scale models of two times or greater, in order to provide stronger, flexible sheet material for this purpose, the material can be a laminate of a non-woven synthetic plastic reinforcing film.

The blank for the mannequin, instead of being provided with a single slot such as slot $S_4$ in the section shown in FIG. 4 to receive a locking tab, can be provided with additional parallel slots such as slots $S_5$ and $S_6$, thereby making it possible to adjust the tubular element created by rolling the section to a tube of a desired diameter.

Thus one can for purposes of forming dressmaker mannequins, create full scale male and female mannequin blanks, each section of which is provided with an array of slots to render it adjustable. Then a mannequin of the proper gender can be assembled over an actual subject for which an article of apparel is to be sewed, each section of which is adjusted to conform to the subject's dimensions and marked to indicate the adjustment. The mannequin can then be disassembled and removed from the subject and then reassembled in accordance with the markings to create a mannequin representing the subject.

Mannequins in accordance with the invention are also usable as targets for weapon practice, as scarecrows, kites, wind socks and wind chimes. Also, they can be controllably animated by means of strings actuated from a VCR system in which playback signals actuate selected electromagnetic devices for operating the strings to simulate desired mannequin movements.

I claim:

1. An animatable mannequin providing a model of a figure having a plurality of tubular members, said mannequin being created from a single blank of flexible sheet material having paper-like qualities formed of non-woven, synthetic plastic fibers which are bonded together to form a sheet, said blank being die-cut to define a predetermined pattern of interconnected sections which are joined together by junctions functioning as living hinges, each of which is contoured to provide when the section is rolled the tubular form of a particular member of the figure including arm, leg and feet members and includes locking tabs projecting from one edge thereof and complementary slots adjacent the opposing edge to receive the tabs, whereby each section is convertible into a locked tubular element by rolling the section and inserting the tabs thereof into the slots, the sizes and shapes of the resultant tubular elements being such as to simulate the members of the figure which because they are interhinged may be moved relative to each other.

2. A mannequin as set forth in claim 1, wherein said tabs include a bendable cut out lug acting as locking means.

3. A mannequin as set forth in claim 1, wherein each section is provided with at least two parallel slots, making it possible, when rolling the section, to adjust the resultant tubular element to a desired diameter.

4. A mannequin as set forth in claim 1 further including a film of flexible plastic material laminated to said sheet to effect reinforcement thereof.

5. A mannequin as set forth in claim 1, in which the mannequin is a reduced scale model of the figure.

6. A mammequin as set forth in claim 1, in which the mannequin is a magnified scale model of the figure.

* * * * *